US005269366A

United States Patent [19]

Zeze et al.

[11] Patent Number: 5,269,366

[45] Date of Patent: Dec. 14, 1993

[54] CONTINUOUS CASTING METHOD OF MULTI-LAYERED SLAB

[75] Inventors: Masafumi Zeze; Takashi Sawai; Eiichi Takeuchi, all of Futtsu, Japan

[73] Assignee: Nippon Steel Corporation, Tokyo, Japan

[21] Appl. No.: 955,863

[22] PCT Filed: Apr. 10, 1992

[86] PCT No.: PCT/JP92/00454

§ 371 Date: Dec. 9, 1992

§ 102(e) Date: Dec. 9, 1992

[87] PCT Pub. No.: WO92/18271

PCT Pub. Date: Oct. 29, 1992

[30] Foreign Application Priority Data

Apr. 12, 1991 [JP] Japan ..... 3-106594
Apr. 12, 1991 [JP] Japan ..... 3-106595

[51] Int. Cl.[5] ..... B22D 27/02; B22D 19/08; B22D 11/18

[52] U.S. Cl. ..... 164/461; 164/466

[58] Field of Search ..... 164/466, 502, 461

[56] References Cited

U.S. PATENT DOCUMENTS 4,828,015 5/1989 Takeuchi et al. ..... 164/466

FOREIGN PATENT DOCUMENTS 64-66052 3/1989 Japan .
1-245952 10/1989 Japan ..... 164/466
1-271031 10/1989 Japan .
3-20295 3/1991 Japan .
3-66447 3/1991 Japan .

*Primary Examiner*—Kuang Y. Lin
*Attorney, Agent, or Firm*—Wenderoth, Lind & Ponack

[57] ABSTRACT

Two kinds of molten steels are poured into a continuous casting mold. Direct current magnetic flux is applied which direct current magnetic flux extends in a direction transverse to the thickness (corresponding to the thickness of a casting slab) of the poured content at a position of a certain height of the mold. The molten steels are supplied above and below a boundary of static magnetic fields formed by the direct current magnetic flux longitudinally or in a casting direction. When a difference ($\Delta\rho$) between a density $\rho_1$ of the molten steel for an outer layer supplied above the static magnetic fields and a density $\rho_2$ of the molten steel for an inner layer supplied below the static magnetic fields, is expressed by $\Delta\rho=\rho_1-\rho_2$ (g/cm$^3$), a density (tesla) of the direct current magnetic flux is determined by the following formula:

a) in case of $\Delta\rho<0$ $$B \geqq [2.83\times(\Delta\rho)^2+1.68\times\Delta\rho+0.30]$$

b) in case of $0\leqq\Delta\rho$ $$B \geqq [20.0\times(\Delta\rho)^2+3.0\times\Delta\rho+0.30]$$

6 Claims, 3 Drawing Sheets

IN CASE OF $\Delta\rho < 0$ $$B \geqq [2.83(\Delta\rho)^2 + 1.68\Delta\rho + 0.30]$$

IN CASE OF $\Delta\rho \geqq 0$ $$B \geqq [20.0(\Delta\rho)^2 + 3.0\Delta\rho + 0.30]$$

CONTINUOUS CASTING METHOD OF MULTI-LAYERED SLAB

TECHNICAL FIELD

The present invention relates to a continuous casting method for continuously casting a multi-layered slab from molten steel, the slab consisting of a surface layer (or an outer layer) and an inner layer, compositions or chemical compositions of which both layers are different from each other.

BACKGROUND ART

As methods for producing clad-steels with a multi-layered structure, there have been known an internal chill method of casting, an explosion bonding method, a roll-bonding method, a cladding method by welding and so on. More specifically, a surface layer of the clad-steel is formed of expensive austenitic stainless steel and an inner layer of the clad steel is formed of cheap normal steel, so that the clad steel product has characteristics of stainless steel and is advantageous in that it can be manufactured more inexpensively than steel materials entirely formed of the austenitic stainless steel.

A continuous casting method of a multi-layered slab as the clad steel has already publicly been known as the prior art previously proposed by the present inventors (refer to JP-A-63-108947). The casting method aims to obtain a multi-layered slab by solidifying two kinds of molten metals which are a content poured in a continuous casting mold while separating the molten metals by magnetic means. In this method, direct current magnetic flux is given at a location of a certain height of the mold, extending transversely to the materials in the mold, and the molten metals having different compositions are respectively supplied above and below a boundary of static magnetic fields formed by the direct current magnetic flux, thereby obtaining a composite metallic mass having the previously solidified upper material (which becomes a surface layer of the solidified casting slab) and the successively solidified lower material (which becomes an inner layer of the solidified casting slab); a boundary between the upper and lower portions of the content is clearly defined, that is to say, the concentration transition layer between the surface layer and the inner layer is thin.

The continuous casting method of the above-described multi-layered slab will now be explained more particularly with reference to FIGS. 3 and 4.

Direct current magnetic flux is applied to a content 4 (molten metals) poured in a continuous casting mold 1 in a molten state, the direct current magnetic flux extending transversely in a direction of thickness of the content over the entirety width of the materials (numeral 10 designates a line of magnetic force). Two kinds of molten metals having different compositions which are the content, are supplied through refractory dip nozzles 2 and 3 above and below a boundary of static magnetic fields 11 formed by the direct current magnetic flux longitudinally in a casting direction. In FIG. 4, it is a cross-sectional view of casting slab 9 to be manufactured, there are shown a solidified surface layer and a solidified inner layer 6. The direct current magnetic flux is formed by magnets 8 in a perpendicular direction to the casting direction A, that is, transversely in the direction of thickness of the content or the partially solidified casting slab in the mold.

It has been recognized from the investigation by the inventors of this application that the publicly-known continuous casting method has a problem that convection mixing resulted from a difference in density between the molten steels in the mold, sometimes happens when a combination of the steels is inadequate so that a mixing restrain effect against the molten steels is not fulfilled by the direct current magnetic flux and preferable separation between the two kinds of molten steels cannot be obtained.

DISCLOSURE OF THE INVENTION

Accordingly, a primary object of the invention is to restrain two kinds of molten steels with different compositions supplied in a mold from being mixed with each other more effectively, and to obtain a casting slab including inner and outer layers (an inner layer and a surface layer) whose compositions are hardly fluctuated.

In view of this object, according to the primary aspect of the invention, there is proposed a continuous casting method of a multi-layered casting slab including inner and outer layers in which direct current magnetic flux is applied to a content poured in a continuous casting mold in a molten state over the entirety width (corresponding to the width of the casting slab) of the content in the mold, the direct current magnetic flux extending in a direction transverse to the thickness (corresponding to the thickness of the casting slab) of the content, and two kinds of molten steels with different compositions which are the content in the mold, are supplied above and below a boundary of static magnetic fields formed by the direct current magnetic flux longitudinally in a casting direction, wherein a direct current magnetic flux density B (tesla) is determined by the following formula:

a) in case of $\Delta\rho<0$ $B \geqq [2.83\times(\Delta\rho)^2+1.68\times\Delta\rho+0.30]$ b) in case of $0\leqq\Delta\rho$ $\geqq [20.0\times(\Delta\rho)^2+3.0\times\Delta\rho+0.30]$ wherein a difference ($\Delta\rho$) between a density $\rho_1$ of the molten steel for an outer layer supplied above the static magnetic fields and a density $\rho_2$ of the molten steel for an inner layer supplied below the static fields is expressed by $\Delta\rho=\rho_1-\rho_2$ (g/cm$^3$)

According to a secondary aspect of the invention, there is proposed another continuous casting method of a multi-layered casting slab in which one or more kinds of alloy elements are added to a molten steel for an outer layer supplied above static magnetic fields or a molten steel for an inner layer supplied below the static magnetic fields, thereby increasing concentrations of the alloy elements in the molten steel. In this method, a composition of one of the two kinds of molten steels poured in the mold is not restricted, but a non-regulated alloy component is added to the molten steel after the molten steel is poured in the mold. A shape of the alloy component to be added may be a wire. It is recommended that an alloy component wire having a coating is used for the purpose of preventing the wire from being melted and consumed before the wire arrives at a target position where the alloy component in the shape of wire is added to the molten metal.

In the invention, a preferable range of a density difference $\Delta\rho$ is $-0.3\leqq\Delta\rho$ (g/cm$^3$)$\leqq 0.23$. Taking such a matter into consideration that the maximum intensity of a direct current magnetic flux density obtainable from an industrially practical level is 0.8 to 1.0 tesla, a range of $-0.3 \leqq \Delta\rho$ (g/cm$^3$) $\leqq 0.1$ is more favorable. It should be noticed that as the density $\rho_2$ of the molten steel for the inner layer is larger than the density $\rho_1$ of the molten steel for the outer layer, mixing of the two kinds of molten steels can be restrained by a smaller flux density B. In other words, in the range of $\Delta\rho$ (g/cm$^3$) $\leqq -0.3$, it is sufficient to apply to the molten steels in the mold, direct current magnetic flux with a density substantially equal to the direct current magnetic flux density of about 0.05 when $\Delta\rho$ (g/cm$^3$) is $-0.3$.

These and other features of the invention will become more apparent from the following description with reference to the drawings.

DETAILED DESCRIPTION OF THE INVENTION

Figure 1:
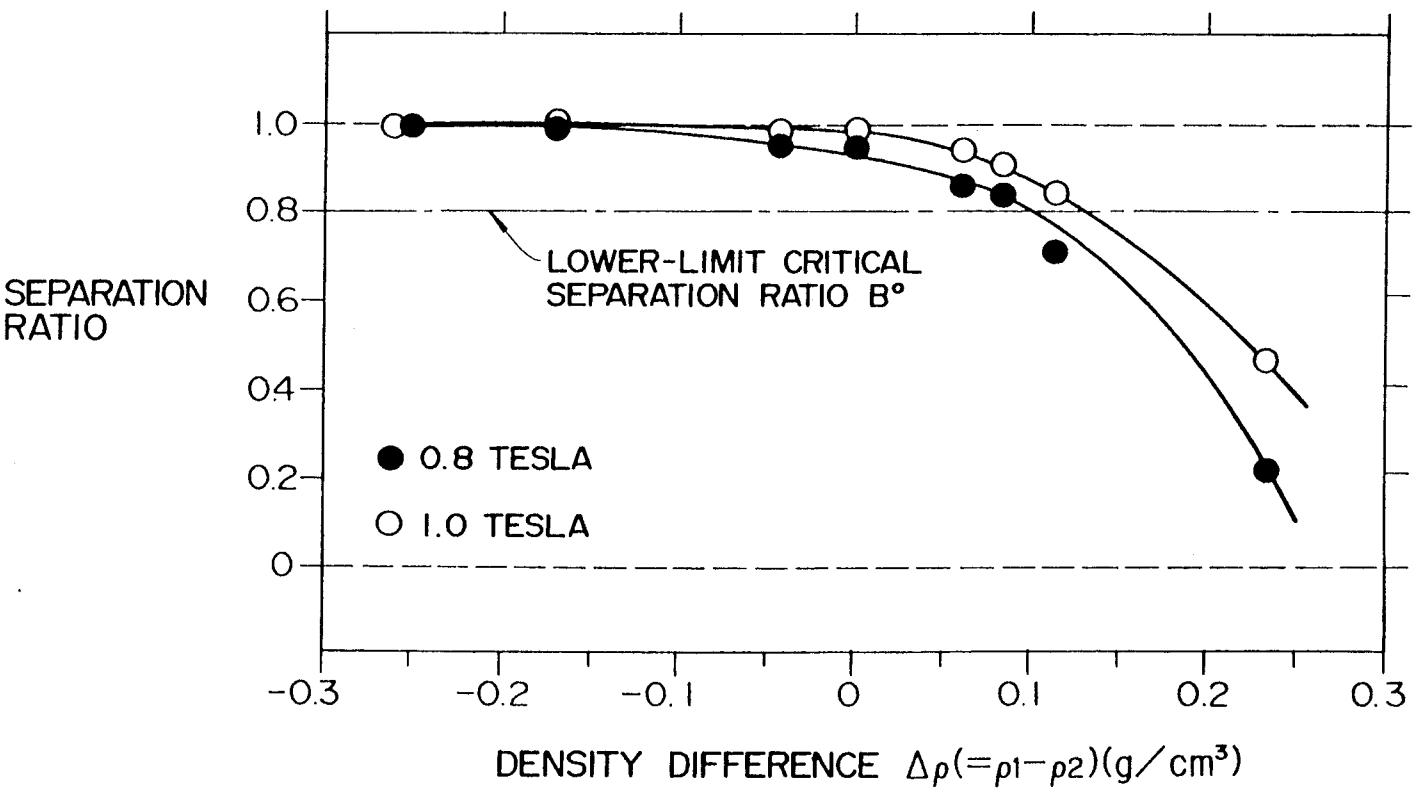
Fig. 1 is a graph of a test result showing relationships between differences $\Delta\rho$ (g/cm$^3$ in density between two kinds of molten steels of various combination and separation ratios of inner and outer layers of test piece casting slabs.

The inventors of this application have investigated a relationship between a difference in density $\Delta\rho$ of two kinds of molten steels and a separating condition of solidified inner and outer layers in a multi-layered casting slab obtained. FIG. 1 is a graph showing a test result, and the details of the test will be described later. This graph illustrates relationships between differences $\Delta\rho$ (g/cm$^3$) in density of two molten steels selected from various kinds of steels and separation ratios of the inner and outer layers in obtained multi-layered casting slabs when the direct current magnetic flux densities are selected at 0.8 and 1.0 tesla. In the graph, the separation ratio is a barometer indicating an extent of separation between concentrations of components in the inner and outer layers of the casting slab. In the case where two kinds of molten steels supplied are completely separated and concentrations of components of the respective steels are maintained as they are in the obtained casting slab, the separation ratio is 1.0. Meanwhile, when the two kinds of molten steels are mixed completely and a distinction between concentrations of components in the inner and outer layers of the casting slab is not determined from each other, the separation ratio is zero. The separation ratio is defined by the following equation.

$$\textit{Separation Ratio} = (C1 - C2)/(C1^0 - C2^0)$$

C1: Concentration of Component in Casting Slab Outer Layer

C2: concentration of Component in Casting Slab inner Layer $C1^0$: Concentration of component in Molten Steel Supplied for Outer Layer $C2^0$: Concentration of component in Molten Steel Supplied for Inner Layer It is understood from FIG. 1 that as the difference in density $\Delta\rho$ (g/cm$^3$) $=\rho_1-\rho_2$ becomes larger, the separation ratio becomes smaller. This is because the convection mixing happens between the molten steels resulted from the density difference thereof so that the mixing restrain effect against the molten steels by the direct current magnetic flux is not fulfilled sufficiently.

A lower-limit critical value ($Bf^0$) of the separation ratio will now be referred to. A favorable lower-limit critical value concerns a material characteristic of an object of a multi-layered casting slab to be expected. The critical value can be predetermined at an arbitrary value not more than 1 in accordance with the kinds of steels. Inv iew of the conventional experiences concerning the material characteristic. assuming that component elements of respective metallic materials are not mixed with each other in excess of 10% in order to obtain desired clad material or composite metallic material effectively available industrially, the lower-limit critical value ($B^0$) of 0.8 is drived from the above-described equation. For the purpose of obtaining preferable separation in which a value of a separation ratio is equal to or larger than the value of the critical separation ratio, it is recognized from FIG. 1 that $\Delta\rho=\rho_1-\rho_2$ is equal to or smaller than 0.1 (g/cm$^3$) under such a condition that the maximum intensity of the direct current magnetic flux obtained from the industrially practical level is 0.8 to 1.0 tesla.

Figure 2:
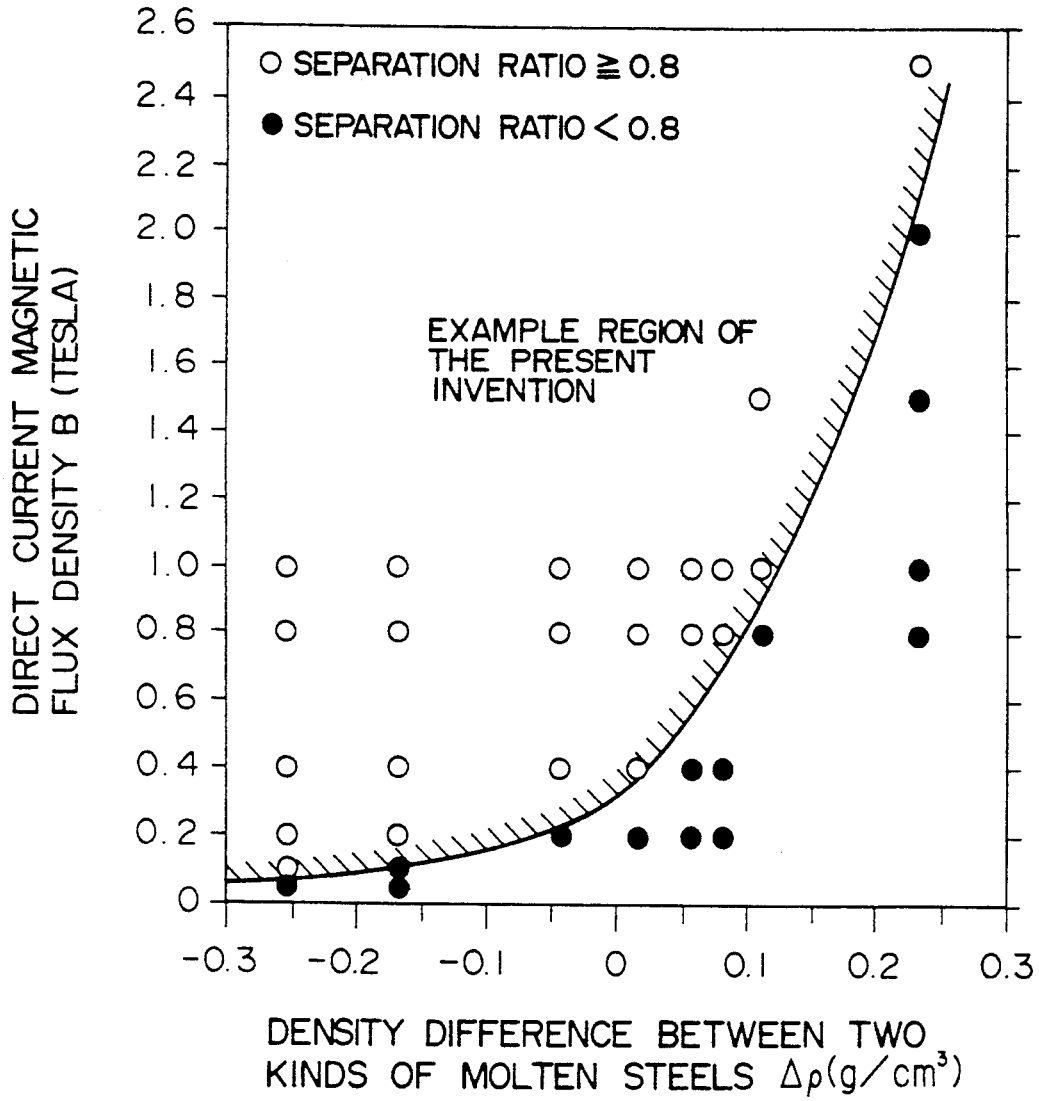
FIG. 2 is a graph of a test result showing relationships between direct current magnetic flux densities and the differences $\Delta\rho$ (g/cm$^3$) in density between the two kinds of molten steels.

The inventors have examined a relationship between a direct current magnetic flux density and a density difference $\Delta\rho$ of two kinds magnetic flux density and a density difference $\Delta\rho$ of two kinds of molten steels, which relationship is required for obtaining preferable separation in which a value of a separation ratio is equal to or larger than the value of the critical separation ratio (the relationship will be described below in detail). FIG. 2 shows a result of the above examination. In the figure, plotted points in case of the separation ratio $\geqq 0.8$ are indicated by marks of ∘, while plotted points in case of the separation ratio $<0.8$ are indicated by makes of •. A region of the marks ∘ and a region of the marks • are separated from each other by a curved line generally in the shape of a parabola. By performing an approximate calculation of quadratic function with respect to the curved line, conditions for obtaining the favorable separation in which the value of the separation ratio is larger than the value of the critical separation ratio of 0.8 are derived a follows.

a) in case of $\Delta\rho<0$ $B \geqq [2.83\times(\Delta\rho)^2+1.68\times\Delta\rho+0.30]$ b) in case of $0 \leqq \Delta\rho$ $B \geqq [20.0\times(\Delta\rho)^2 3.0\times\Delta\rho+0.30]$ Under such conditions, a direct current magnetic flux density necessary for separation of two layers of a casting slab is given in response to a density difference between two kinds of molten steels, to thereby surely manufacture a multi-layered casting slab.

Besides, a range of a density difference of $\Delta\rho$ (g/cm$^3$) $\leqq -0.3$ is not illustrated in FIG. 2. In the range of the density difference $\Delta\rho$ (g/cm$^3$) $\leqq -0.3$, however, as the density $\rho_2$ of the molten steel for the inner layer is larger than the $\rho_1$ of the molten steel for the outer layer, the two kinds of molten steels can be restricted from mixing by a smaller magnetic flux density B. In view of this, therefore, it is sufficient that a direct current magnetic flux whose density is substantially equal to the direct current magnetic flux density of about 0.05 which is required when $\Delta\rho = -0.3$, is applied to the molten steels in the mold.

EXPERIMENT EXAMPLE

Figure 3:
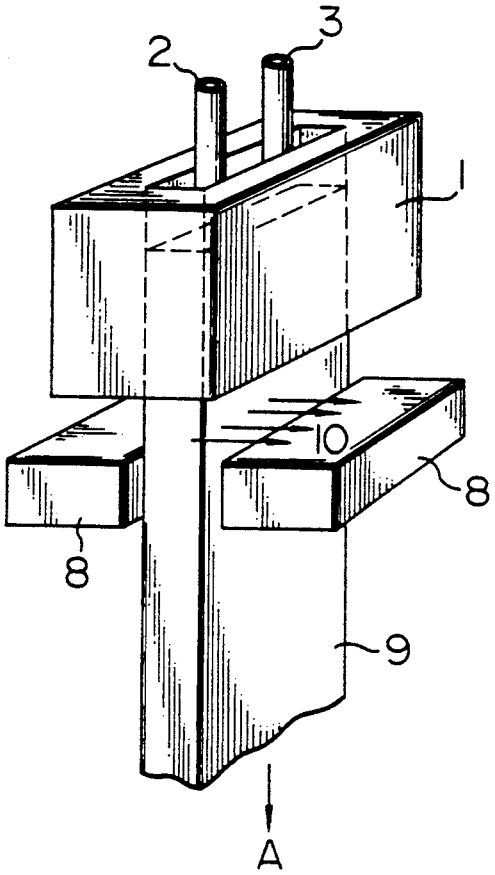
FIG. 3 PRIOR ART
FIG. 3 is a perspective view of a continuous casting apparatus of a multi-layered casting slab according to the prior art.
Figure 4:
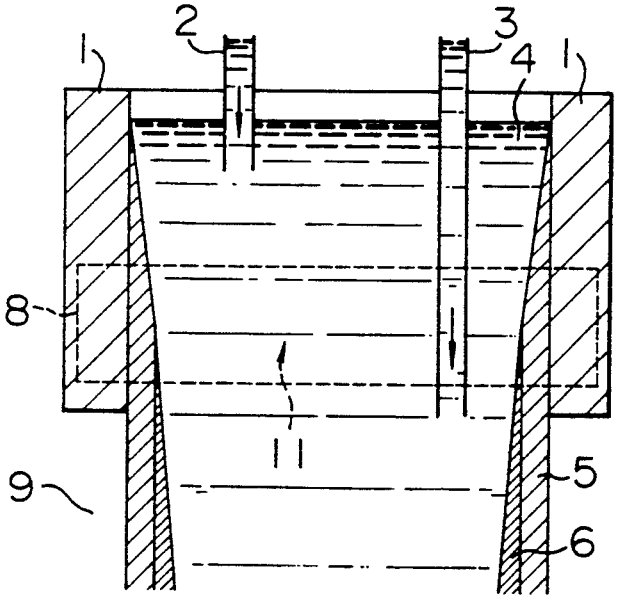
FIG. 4 PRIOR ART
FIG. 4 is a vertically cross-sectional view of the apparatus shown in FIG. 3, taken in a direction of width of the casting slab.

An experiment example will be described with reference to FIGS. 3 and 4 which illustrate a publicly-known apparatus. Two kinds of molten steels with different compositions were poured above and below a boundary of static magnetic fields 11 in a continuous casting mold 1, through two alumina-graphite dip nozzles 2 and 3 having lengths and inner diameters different from each other. Casting conditions were as follows.

Mold configuration: rectangular shape in lateral cross-section, size: 250 mm (in a direction of thickness of a cast slab)×1200 mm (in a direction of width of the casting slab)

Inner diameter of the cylindrical nozzle for pouring the molten steel used for an outer layer: 40 mm Inner diameter of the cylindrical nozzle for pouring the molten steel for an inner layer: 70 mm Position of a discharge port of the molten steel pouring nozzle for the outer layer with respect to a meniscus of the molten steel: −100 mm Position of a discharge port of the molten steel pouring nozzle for the inner layer with respect to the meniscus of the molten steel: −800 mm Casting velocity: 1.0 m/min.

Static magnetic field: top and bottom ends of a magnet were respectively located by 450 mm and 700 mm, below the meniscus of the molten steel in the mold.

Direct current magnetic flux density: 0.05 to 2.5 tesla, the density being representative of the intensity at a location of an intermediate portion of the magnet in a direction of the thickness (or height) along the casting direction.

Table 1 shows various combinations of two kinds of steels to be cast and compositions of the respective steels.

In relation to Table 1, Table 2 specifies casting temperatures, densities of the steels at the respective temperatures and density differences of the respective combinations of the steels.

Further, the inventors examined distributions of concentrations in directions of thickness of casting slabs obtained from the respective combinations of the two steels when the direct current magnetic flux is applied thereto while varying the density of the direct current magnetic flux. Table 3 shows a result of comparison of the separation ratios calculated by the above-described formula with the critical separation ratio of 0.8. As a result of comparison, combinations whose separation ratios are not less than 0.8 are indicated by the marks ○ and combinations whose separation ratios are less than 0.8 are indicated by the marks ●. A boundary between the region where the marks ○ exist and the region where the marks ● exist is depicted by a heavy line.

Table 4 described the items partially extracted from Table 3, in which there are shown separation ratios of the casting slabs obtained from the respective combinations of two kinds of steels when the applied direct current magnetic flux is 0.8 and 1.0 tesla.

TABLE 1

| Kind of steel | | | Chemical Composition (wt %) | | | | | | | | |
|---|---|---|---|---|---|---|---|---|---|---|---|
| | | | C | Si | Mn | P | S | Ti | Nb | Cr | Ni |
| A | 1 | FOL | 0.016 | 0.46 | 0.85 | 0.014 | 0.004 | | | 18.75 | 10.97 |
| | 2 | FIL | 0.0032 | 0.039 | 0.16 | 0.006 | 0.005 | 0.014 | 0.017 | | |
| B | 1 | FOL | 0.014 | 0.48 | 0.80 | 0.013 | 0.004 | | | 18.82 | 10.91 |
| | 2 | FIL | 0.0056 | 0.97 | 0.18 | 0.007 | 0.004 | | 0.076 | | |
| C | 1 | FOL | 0.109 | 0.238 | 2.08 | 0.007 | 0.004 | 0.081 | | | |
| | 2 | FIL | 0.003 | 0.014 | 0.15 | 0.007 | 0.005 | 0.053 | | | |
| D | 1 | FOL | 0.0055 | 0.034 | 0.23 | 0.005 | 0.005 | 0.003 | 0.008 | | |
| | 2 | FIL | 0.0075 | 0.018 | 0.19 | 0.006 | 0.006 | 0.101 | 0.013 | | |
| E | 1 | FOL | 0.05 | 0.287 | 0.42 | 0.011 | 0.011 | | | | 5.15 |
| | 2 | FIL | 0.115 | 0.189 | 0.84 | 0.007 | 0.007 | | | | |
| F | 1 | FOL | 0.043 | 0.022 | 0.47 | 0.009 | 0.004 | | 0.01 | | |
| | 2 | FIL | 0.135 | 0.762 | 2.03 | 0.079 | 0.006 | | | | |
| G | ① | FOL | 0.043 | 0.03 | 0.51 | 0.008 | 0.004 | | 0.02 | | |
| | ② | FIL | 0.119 | 1.207 | 1.66 | 0.084 | 0.040 | | | | |
| H | ① | FOL | 0.0043 | 0.03 | 0.25 | 0.008 | 0.004 | 0.015 | | | |
| | ② | FIL | 0.0050 | 3.05 | 0.25 | 0.005 | 0.005 | | | | |

*FOL: For Outer Layer, FIL: For Inner Layer

TABLE 2

| Kind of steel | | | Casting temperature (°C.) | Density of molten steel (g/cm³) | Density difference (g/cm³) |
|---|---|---|---|---|---|
| A | ① | FOL | 1538 | 6.730 | −0.253 |
| | ② | FIL | 1562 | 6.983 | |
| B | ① | FOL | 1535 | 6.731 | −0.168 |
| | ② | FIL | 1570 | 6.899 | |
| C | ① | FOL | 1568 | 6.915 | −0.042 |
| | ② | FIL | 1597 | 6.957 | |
| D | ① | FOL | 1575 | 6.971 | 0.002 |
| | ② | FIL | 1580 | 6.969 | |
| E | ① | FOL | 1552 | 6.986 | 0.061 |
| | ② | FIL | 1592 | 6.925 | |
| F | ① | FOL | 1583 | 6.958 | 0.084 |
| | ② | FIL | 1557 | 6.874 | |
| G | ① | FOL | 1580 | 6.959 | 0.114 |
| | ② | FIL | 1554 | 6.845 | |
| H | ① | FOL | 1580 | 6.967 | 0.234 |
| | ② | FIL | 1559 | 6.733 | |

*FOL: For Outer Layer, FIL: For Inner Layer

TABLE 3

| Combination | Separation Ratio | | | | | | | | |
|---|---|---|---|---|---|---|---|---|---|
| | Magnetic flux density (Tesla) | | | | | | | | |
| | 0.05 | 0.10 | 0.20 | 0.40 | 0.80 | 1.00 | 1.50 | 2.00 | 2.50 |
| A | ● | ○ | ○ | ○ | ○ | | | | |
| | 0.79 | 0.82 | 0.88 | 0.95 | 0.99 | 0.99 | | | |
| B | ● | ● | ○ | ○ | ○ | | | | |
| | 0.73 | 0.78 | 0.85 | 0.94 | 0.98 | 0.99 | | | |
| C | | | ● | ○ | ○ | ○ | | | |
| | | | 0.78 | 0.89 | 0.96 | 0.98 | | | |
| D | | | ● | ○ | ○ | ○ | | | |
| | | | 0.70 | 0.85 | 0.95 | 0.98 | | | |
| E | | | ● | ● | ○ | ○ | | | |
| | | | 0.50 | 0.71 | 0.85 | 0.93 | | | |
| F | | | ● | ● | ○ | ○ | | | |
| | | | 0.45 | 0.65 | 0.83 | 0.93 | | | |
| G | | | | | ● | ○ | ○ | | |
| | | | | | 0.71 | 0.83 | 0.88 | | |

TABLE 3-continued

| Combination | Separation Ratio | | | | | | | | |
|---|---|---|---|---|---|---|---|---|---|
| | Magnetic flux density (Tesla) | | | | | | | | |
| | 0.05 | 0.10 | 0.20 | 0.40 | 0.80 | 1.00 | 1.50 | 2.00 | 2.50 |
| H | | | | | • 0.21 | • 0.45 | • 0.56 | • 0.67 | ○ 0.82 |

○: Separation ratio ≧ 0.8,
•: Separation ratio < 0.8

TABLE 4

| Combination | Separation ratio | |
|---|---|---|
| | Magnetic flux density | |
| | 0.8 T | 1.0 T |
| A | 0.99 | 0.99 |
| B | 0.98 | 0.99 |
| C | 0.96 | 0.98 |
| D | 0.95 | 0.98 |
| E | 0.85 | 0.93 |
| F | 0.83 | 0.90 |
| G | 0.71 | 0.83 |
| H | 0.21 | 0.45 |

FIG. 1 is a graph showing the relationship between the density differences of the two kinds of steels and the separation ratios when the steels are exposed in the direct current magnetic flux having densities of 0.8 tesla and 1.0 tesla, the relationship being extracted from Table 4. It is recognized from FIG. 1 that the separation of the layers preferably exists and the separation ratio hardly changes in the range of $\Delta\rho(=\rho_1-\rho_2)\leqq 0$, and that as $\Delta\rho$ becomes larger, the separation ratio becomes smaller rapidly so that the separation is deteriorated.

FIG. 2 is a graph drafted according to Tables 2 and 3. As previously explained in FIG. 2, it is understood that there exist a region (a region bordered by the curved line in the figure) where the preferable separation in which the value of the separation ratio is equal to or larger than the value of the critical separation ratio of 0.8 can be obtained by varying the direct current magnetic flux density applied to the two kinds o steels to be manufactured into the casting slab, the preferable separation ratio being indispensable for enjoying a characteristic brought by compounding the two kinds of steels without losing features of the steels (base materials) which become an outer layer and an inner layer of the casting slab, respectively.

INDUSTRIAL APPLICABILITY

According to the continuous casting method of the invention, it is possible to industrially mass-produce clad steel formed of two kinds of steels with different compositions inexpensively. As one example, there exists clad steel of which outer layer is formed of expensive austenitic stainless steel and of which inner layer is formed of cheap normal steel.

What is claimed is:

1. A continuous casting method of a multi-layered slab including inner and outer layers in which direct current magnetic flux is applied to a content to be poured into a continuous casting mold in a molten state over the entirety width of said content, the direct current magnetic flux being extending in a direction transverse to the thickness of said content, and two kinds of molten steels having different compositions which are said content are supplied above and below a boundary of static magnetic fields formed by said direct current magnetic flux longitudinally or in a direction of casting, wherein a magnetic flux density B (tesla) of said direct current flux is determined by the following formula:

a) in case of $\Delta\rho<0$ $B\geqq[2.83\times(\Delta\rho)^2+1.68\times\Delta\rho+0.30]$ b) in case of $0\leqq\Delta\rho$ $B\geqq[20.0\times(\Delta\rho)^2+3.0\times\Delta\rho+0.30]$ wherein a difference ($\Delta\rho$) between a density $\rho_1$ of the molten steel for an outer layer supplied above the static magnetic fields and a density $\rho_2$ of the molten steel for an inner layer supplied below the static magnetic fields is expressed by $\Delta\rho=\rho_1-\rho_2$ (g/cm$^3$).

2. A continuous casting method of a multi-layered slab according to claim 1, wherein $\Delta\rho$ (g/cm$^3$) is within a range of $-0.3\leqq\Delta\rho\leqq 0.23$.

3. A continuous casting method of a multi-layered slab according to claim 1, wherein $\Delta\rho$ (g/cm$^3$) is within a range of $-0.3\leqq\Delta\rho\leqq 0.1$.

4. A continuous casting method of a multi-layered slab including inner and outer layers in which direct current magnetic flux is applied to a content to be poured into a continuous casting mold in a molten state over the entirety width of said content, the direct current magnetic flux being extending in a direction transverse to the thickness of said content, and two kinds of molten steels having different compositions which are the content are supplied above and below a boundary of static magnetic fields formed by said direct current magnetic flux longitudinally or in a direction of casting, wherein one or more kinds of alloy elements are added to the molten steel for an outer layer supplied above the electric magnetic fields or the molten steel for an inner layer below the static magnetic fields in order to increase concentrations of said alloy elements in said molten steel, and a magnetic flux density B (tesla) of said direct current magnetic flux is determined by the following formula:

a) in case of $\Delta\rho<0$ $B\geqq[2.83\times(\Delta\rho)^2+1.68\times\Delta\rho+0.30]$ b) in case of $0\leqq\Delta\rho$ $B\geqq[20.0\times(\Delta\rho)^2+3.0\times\Delta\rho+0.30]$ wherein a difference ($\Delta\rho$) between a density $\rho_1$ of the molten steel for the outer layer and a density $\rho_2$ of the molten steel for the inner layer is expressed by $\Delta\rho=\rho_1-\rho_2$ (g/cm$^3$).

5. A continuous casting method of a multi-layered slab according to claim 4, wherein $\Delta\rho$ (g/cm$^3$) is within a range of $-0.3\leqq\Delta\rho\leqq 0.23$.

6. A continuous casting method of a multi-layered slab according to a claim 4, wherein $\Delta\rho$ (g/cm$^3$) is within a range of $-0.3\leqq\Delta\rho\leqq 0.1$.

* * * * *